US009073361B2

(12) United States Patent
Murata et al.

(10) Patent No.: US 9,073,361 B2
(45) Date of Patent: Jul. 7, 2015

(54) LIQUID EJECTION APPARATUS

(71) Applicants: Satoshi Murata, Nagoya (JP); Shigeki Kato, Toyoake (JP)

(72) Inventors: Satoshi Murata, Nagoya (JP); Shigeki Kato, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/230,745

(22) Filed: Mar. 31, 2014

(65) Prior Publication Data

US 2014/0354728 A1 Dec. 4, 2014

(30) Foreign Application Priority Data

May 31, 2013 (JP) ..... 2013-115712

(51) Int. Cl.

| | |
|---|---|
| ***B41J 29/38*** | (2006.01) |
| ***B41J 2/01*** | (2006.01) |
| ***B41J 11/00*** | (2006.01) |
| ***B41J 3/60*** | (2006.01) |

(52) U.S. Cl.

CPC . *B41J 11/002* (2013.01); *B41J 3/60* (2013.01)

(58) Field of Classification Search

CPC ..... B41J 3/60; B41J 11/002; B41J 11/007
USPC ..... 347/16, 101, 102, 104
See application file for complete search history.

(56) References Cited

U.S. PATENT DOCUMENTS

| | | | | |
|---|---|---|---|---|
| 2012/0050376 | A1* | 3/2012 | Nagoshi et al. | 347/19 |
| 2013/0135409 | A1* | 5/2013 | Ito et al. | 347/104 |

FOREIGN PATENT DOCUMENTS

| | | | |
|---|---|---|---|
| JP | 2001-063019 | A | 3/2001 |
| JP | 2008-080808 | A | 4/2008 |
| JP | 2009-083355 | A | 4/2009 |
| JP | 2010-000711 | A | 1/2010 |

* cited by examiner

*Primary Examiner* — Jannelle M Lebron
(74) *Attorney, Agent, or Firm* — Merchant & Gould PC

(57) ABSTRACT

A liquid ejection apparatus includes: a liquid ejection head; a first conveyor for conveying a recording medium in a first direction to a recording position; a second conveyor disposed downstream of the recording position; a third conveyor for returning the recording medium to the first conveyor; and a dryer disposed at a drying position located downstream of the recording position in the first direction. A controller controls: image recording on a first surface of the recording medium opposite its second surface (first processing); the second conveyor to convey the recorded recording medium in the first direction until its upstream edge portion reaches a downstream side of the drying position in the first direction (second processing); the second conveyor to convey the recording medium in a second direction (third processing); and image recording on the second surface (fourth processing). The dryer dries the recording medium in the second processing.

16 Claims, 10 Drawing Sheets

LIQUID EJECTION APPARATUS

CROSS REFERENCE TO RELATED APPLICATION

The present application claims priority from Japanese Patent Application No. 2013-115712, which was filed on May 31, 2013, the disclosure of which is herein incorporated by reference in its entirety.

BACKGROUND

1. Technical Field

The present invention relates to a liquid ejection apparatus configured to eject liquid such as ink.

2. Description of the Related Art

There is known a liquid ejection apparatus configured to record images respectively on opposite surfaces (first and second surfaces) of a recording medium. There is also known another liquid ejection apparatus configured to dry a recording medium after image recording to prevent smear of liquid on a recording medium. For example, a liquid ejection apparatus of this kind uses an output roller having a heater therein to convey a sheet and dry the sheet for which an image is recorded on its first surface. After rotation of the output roller is temporarily stopped in a state in which a trailing edge of the sheet is nipped by the output roller, the output roller is rotated in a reverse direction to supply the sheet again for image recording on the second surface of the sheet.

In this liquid ejection apparatus, after the rotation of the output roller is temporarily stopped in the state in which the trailing edge of the sheet is nipped by the output roller, the heater is turned off, and the output roller is rotated in the reverse direction. Alternatively, after the rotation of the output roller is temporarily stopped in the state in which the trailing edge of the sheet is nipped by the output roller, the output roller is rotated in the reverse direction to supply the sheet again for image recording on the second surface of the sheet, and the heater is turned off after the image recording on the second surface.

SUMMARY

However, some length of time is required for the output roller to return to a normal temperature from turning-off of the heater. Accordingly, in the above-described configuration in which the output roller is rotated in the reverse direction in the state in which the trailing edge of the sheet is nipped by the output roller, a large amount of heat is applied to the trailing edge of the sheet regardless of the timing of turning off the heater when compared with other areas on the sheet. This results in unevenness in a degree of dryness of a recording medium, i.e., the sheet, leading to curl and discoloration of the recording medium.

This invention has been developed to provide a liquid ejection apparatus capable of reducing unevenness in a degree of dryness of a recording medium.

The present invention provides a liquid ejection apparatus, including: a liquid ejection head formed with a plurality of ejection openings and configured to eject liquid from the plurality of ejection openings; a first conveyor configured to convey a recording medium in a first direction to a recording position which opposes the plurality of ejection openings; a second conveyor disposed downstream of the recording position in the first direction, the second conveyor being configured to convey the recording medium conveyed by the first conveyor, in the first direction and a second direction that is reverse to the first direction; a third conveyor configured to convey the recording medium conveyed in the second direction by the second conveyor, to an upstream side of the recording position in the first direction to enter the recording medium into a conveyance path of the first conveyor; a dryer configured to dry the recording medium conveyed by the second conveyor, at a drying position located downstream of the recording position in the first direction; and a controller configured to control the liquid ejection head, the first conveyor, the second conveyor, the third conveyor, and the dryer. The controller is configured to execute: a first processing in which the controller controls the liquid ejection head and the first conveyor to record an image on a first surface of the recording medium which opposes a second surface thereof; a second processing in which after the first processing the controller controls the second conveyor to convey the recording medium for which the image is recorded on the first surface thereof; in the first direction until an upstream edge portion of the recording medium in the first direction reaches a position located downstream of the drying position in the first direction; a third processing in which after the second processing the controller controls the second conveyor to convey the recording medium for which the image is recorded on the first surface thereof, in the second direction; and a fourth processing in which after the third processing the controller controls the third conveyor, the first conveyor, and the liquid ejection head to record an image on the second surface of the recording medium. The controller is configured to control the dryer to dry the recording medium at least in the second processing.

The present invention provides a liquid ejection apparatus, including: a liquid ejection head formed with a plurality of ejection openings and configured to eject liquid from the plurality of ejection openings; a first conveyor configured to convey a recording medium in a first direction to a recording position which opposes the plurality of ejection openings; a second conveyor disposed downstream of the recording position in the first direction, the second conveyor being configured to convey the recording medium conveyed by the first conveyor, in the first direction and a second direction that is reverse to the first direction; a third conveyor configured to convey the recording medium conveyed in the second direction by the second conveyor, to an upstream side of the recording position in the first direction to enter the recording medium into a conveyance path of the first conveyor; and a dryer configured to dry the recording medium conveyed by the second conveyor, at a drying position located downstream of the recording position in the first direction. The dryer includes: a first forward/reverse rotatable roller pair at least partly constituting the second conveyor and rotatable forwardly and reversely; and a heater configured to heat at least one of two rollers constituting the first forward/reverse rotatable roller pair. The second conveyor includes a second forward/reverse rotatable roller pair rotatable forwardly and reversely and disposed downstream of the drying position in the first direction.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

Figure 1:
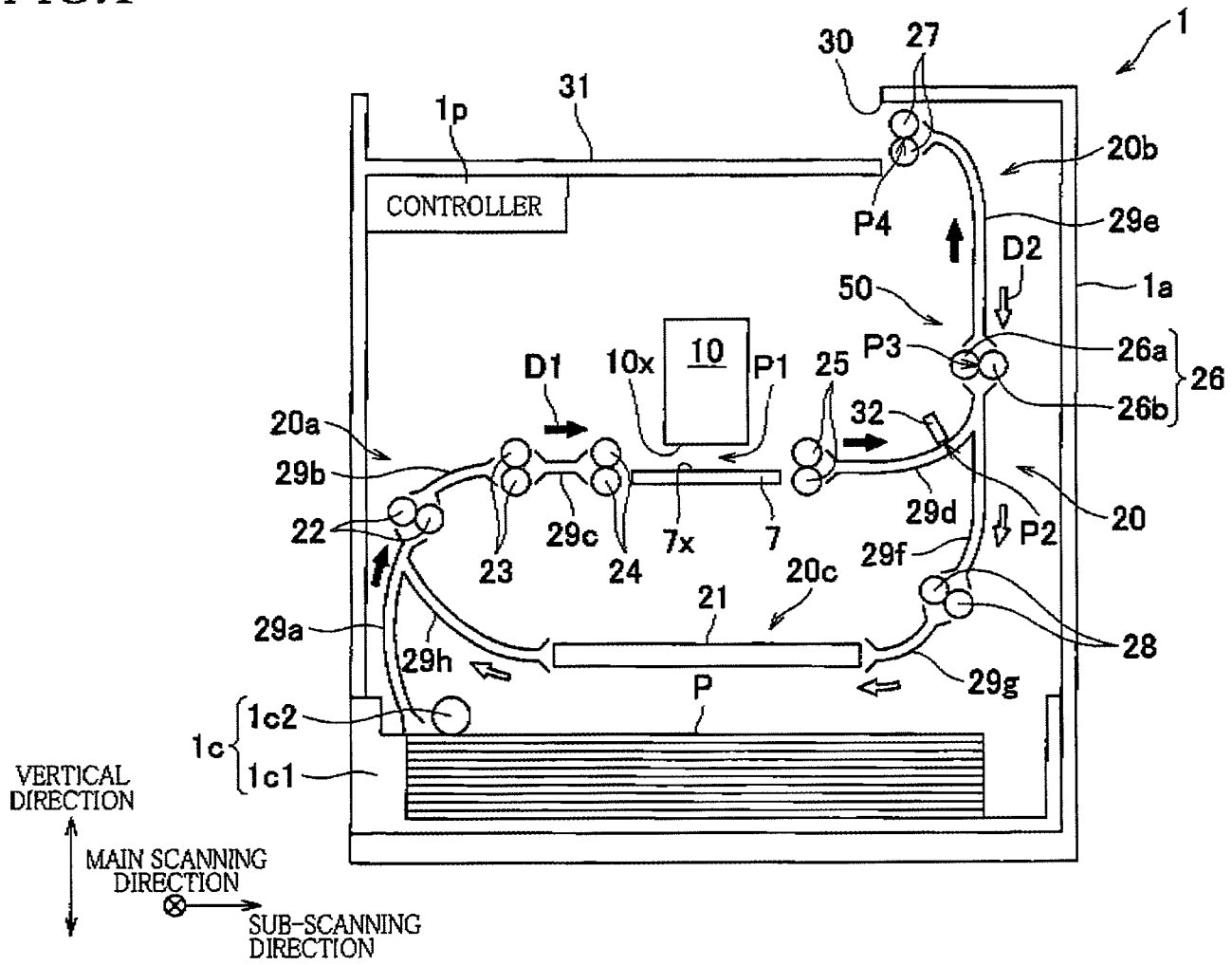
FIG. 1 is a schematic side view illustrating an internal structure of an ink-jet printer according to a first embodiment of the present invention.

Hereinafter, there will be described embodiments of the present invention by reference to the drawings.

First, there will be explained, with reference to FIG. 1, an overall configuration of an ink-jet printer 1 according to a first embodiment of the present invention.

The printer 1 includes a housing 1*a* having a rectangular parallelepiped shape. A sheet-output portion 31 is provided on a top plate of the housing 1*a*. The housing 1*a* accommodates an ink-jet head 10, a platen 7, a conveyor unit 20, a dryer 50, a sensor 32, a sheet-supply unit 1*c*, a controller 1*p*, and so on. Formed in the housing 1*a* is a sheet conveyance path through which a sheet P is conveyed from the sheet-supply unit 1*c* to the sheet-output portion 31 along bold arrows illustrated in FIG. 1. A cartridge, not shown, storing black ink to be supplied to the head 10 is removably provided in the housing 1*a*. The cartridge is connected to the head 10 by a tube and other connecting members to supply the ink to the head 10.

The head 10 is a line head having a generally rectangular parallelepiped shape elongated in a main scanning direction or a direction perpendicular to a sheet surface of FIG. 1. A lower surface of the head 10 is an ejection surface 10*a* having a multiplicity of ejection openings 14*a* (see FIGS. 3 and 4) opened therein.

The platen 7 is a flat plate disposed opposing the ejection surface 10*x*. A space appropriate for recording is formed between an upper surface 7*x* of the platen 7 and the ejection surface 10*x*.

The conveyor unit 20 includes a first conveyor 20*a*, a second conveyor 20*b*, and a third conveyor 20*c*. The first conveyor 20*a* conveys the sheet P supplied from the sheet-supply unit 1*c*, to a recording position P1 in a first direction D1 which is a direction indicated by the bold arrows in FIG. 1. The first conveyor 20*a* includes roller pairs 22-24 and guides 29*a*-29*c*. The recording position P1 is located on the upper surface 7*x* of the platen 7 and opposes the ejection openings 14*a*. The second conveyor 20*b* is disposed downstream of the recording position P1 in the first direction D1 and designed to convey the sheet P conveyed by the first conveyor 20*a*, in the first direction D1 and a second direction D2 different from or reverse to the first direction D1 which is indicated by white arrows in FIG. 1. The second conveyor 20*b* includes roller pairs 25-27 and guides 29*d*, 29*e*. Two roller pairs 26, 27 of the three roller pairs 25-27 are forward/reverse rotatable roller pairs each rotatable in forward and reverse directions. The roller pair 27 is one example of a first forward/reverse rotatable roller pair, and the roller pair 26 is one example of a second forward/reverse rotatable roller pair. The third conveyor 20*c* conveys the sheet P conveyed by the second conveyor 20*b* in the second direction D2, to a position located upstream of the recording position P1 in the first direction D1 (i.e., a position near the roller pair 22 on an upstream side thereof) so as to return the sheet P into a sheet conveyance path of the first conveyor 20*a*. The third conveyor 20*c* includes a cassette 21, a roller pair 28, and guides 29*f*-29*h*.

Figure 5:
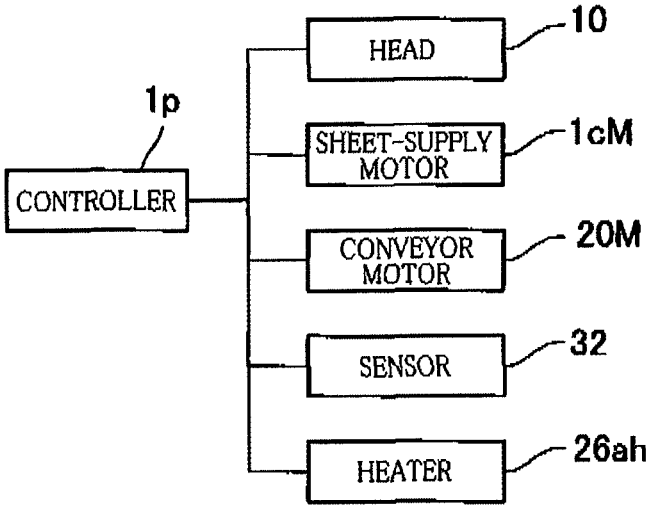
FIG. 5 is a block diagram illustrating an electric configuration of the printer in FIG. 1.

The roller pairs 22-28 are arranged in the sheet conveyance path so as to be spaced apart from each other appropriately. One roller of each of the roller pairs 22-28 is a drive roller which is rotated by a conveyor motor 20M (see FIG. 5) under control of the controller 1*p*. The other roller of each of the roller pairs 22-28 is a driven roller which is rotated by the rotation of the one roller. In each of the roller pairs 22-28, the one roller and the other roller nipping the sheet P therebetween are rotated such that the rotational direction of the one roller and the rotational direction of the other roller are reverse to each other. All the roller pairs 22-28 are driven by the conveyor motor 20M so as to be rotated at the same speed. Each of the guides 29*a*-29*h* is constituted by a pair of plates which are spaced apart from each other in a planar direction. The cassette 21 is disposed over a sheet-supply tray 1*c*1 and under the platen 7 so as to define a space through which the sheet P can be conveyed.

The dryer 50 is designed to dry the sheet P conveyed by the second conveyor 20*b*, at a drying position P3 located downstream of the recording position P1 in the first direction D1. The dryer 50 includes a roller pair 26 and a heater 26*ah* (see FIG. 5). The heater 26*ah* heats one of two rollers 26*a*, 26*b* constituting the roller pair 26, in the present embodiment, the heater 26*ah* heats the roller 26*a*. Under the control of the controller 1*p*, when the heater 26*ah* is turned on, the heater 26*ah* heats the roller 26*a* to apply heat to a portion of the sheet P which is nipped by the roller pair 26, thereby drying the portion of the sheet P. In other words, the roller 26*a* is a contact member which contacts one of opposite surfaces of the sheet P to apply heat to the sheet P. The drying position P3 is a position at which the roller pair 26 nips the sheet P.

The sensor 32 outputs a signal based on the presence or absence of the sheet P and is disposed upstream of the drying position P3 in the first direction D1. The sensor 32 senses the presence or absence of the sheet P at a sensing position P2 located on the sheet conveyance path.

The sheet-supply unit 1*c* includes the sheet-supply tray 1*c*1 and a sheet-supply roller 1*c*2. The sheet-supply tray 1*c*1 is removable from the housing 1*a*. The sheet-supply tray 1*c*1 is a container opening upward and capable of containing a plurality of sheets P. The controller 1*p* drives a sheet-supply motor 1*c*M (see FIG. 5) to rotate the sheet-supply roller 1*c*2, supplying an uppermost one of the sheets P accommodated in the sheet-supply tray 1*c*1.

The controller 1*p* includes a central processing unit (CPU) as a computing device, a read only memory (ROM), a random access memory (RAM) including a non-transitory RAM, an application specific integrated circuit (ASIC), an interface (I/F), an input/output port (I/O), and a timer. The ROM stores programs to be executed by the CPU, various kinds of fixed data, and other similar data. The RAM temporarily stores data such as image data necessary for execution of the programs. The ASIC executes rewriting and sorting of image data and other processings such as a signal processing and an image processing. The interface transmits and receives data to and from an external device such as a PC connected to the printer 1. The input/output port inputs and outputs signals transmitted from various sensors. It is noted that the controller 1*p* may not include the ASIC, and the programs and so on executed by the CPU may execute rewriting and sorting of image data and other processings.

The controller 1*p* controls the head 10 and the conveyor unit 20 to record an image on the sheet P based on a recording command supplied from the external device. That is, the controller 1*p* controls a sheet conveying operation in which the conveyor unit 20 conveys the sheet P, and an ink ejecting operation in which the head 10 ejects the ink onto the sheet P being conveyed.

The sheet P supplied by the sheet-supply unit 1*c* is conveyed in the first direction D1 by the first conveyor 20*a* being controlled by the controller 1*p*. When the sheet P passes through the recording position PI, the controller 1*p* controls the head 10 to eject the ink from the ejection openings 14*a* (see FIG. 4) onto a surface of the sheet P or a first surface (i.e., a surface of the sheet P which faces downward in the sheet-supply tray 1*c*1) to record an image on the surface of the sheet P. In the case of simplex recording in which an image is formed only one of opposite surfaces of the sheet P, the sheet P is thereafter discharged onto the sheet-output portion 31 from an opening 30 formed in an upper portion of the housing 1*a*. In the ease of duplex recording in which images are recorded respectively on a front surface and a back surface or a second surface of the sheet P, the controller 1*p* reverses rotational directions of the roller pairs 26, 27 when the sheet P is nipped by the roller pair 27. As a result, the sheet P is conveyed by the second conveyor 20*b* in the second direction D2 so as to be conveyed to the third conveyor 20*c*. The third conveyor 20*c* conveys the sheet P into the conveyance path of the first conveyor 20*a* at the position located upstream of the recording position PI in the first direction D1 (i.e., the position near the roller pair 22 on an upstream side thereof). The sheet P is conveyed by the first conveyor 20*a* again in the first direction D1 to the recording position P1 where an image is recorded on the back surface of the sheet P, and thereafter the sheet P is discharged from the opening 30 onto the sheet-output portion 31. A command for the simplex recording or the duplex recording is contained in the recording command.

Figure 2:
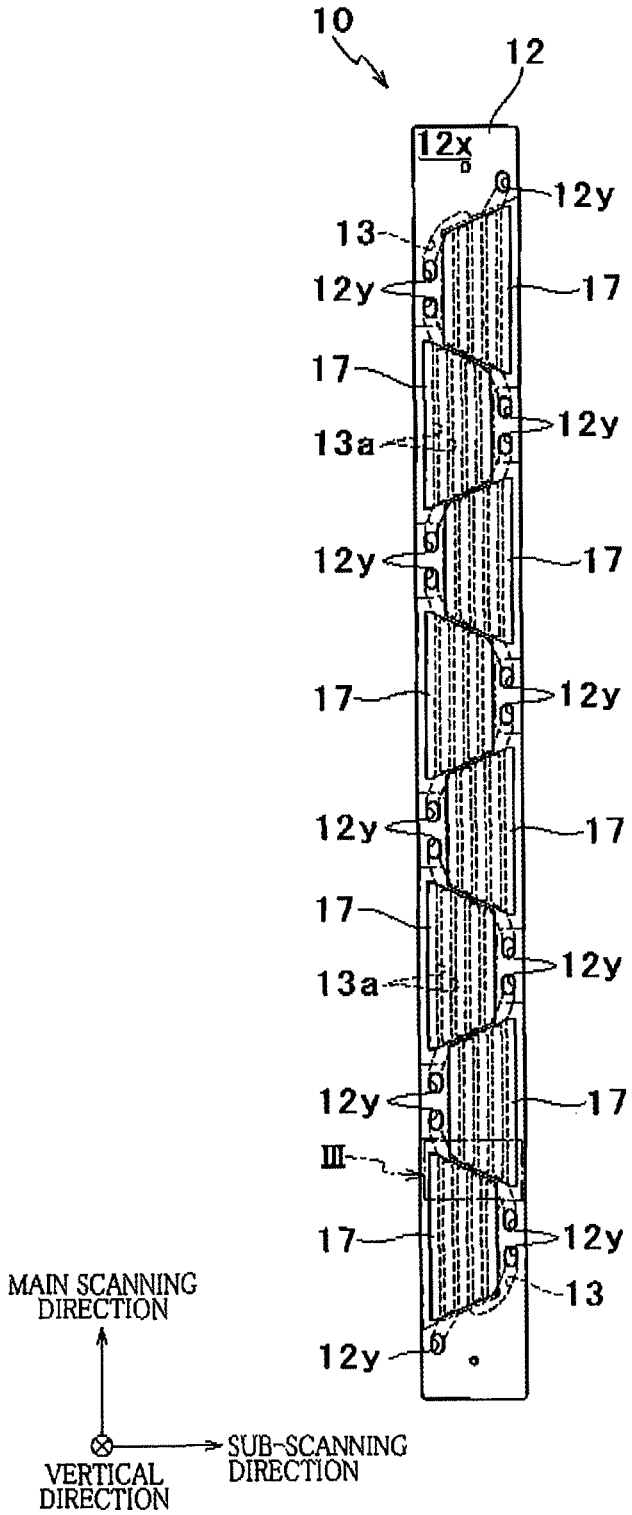
FIG. 2 is a plan view illustrating an ink-jet head of the printer in FIG. 1.
Figure 3:
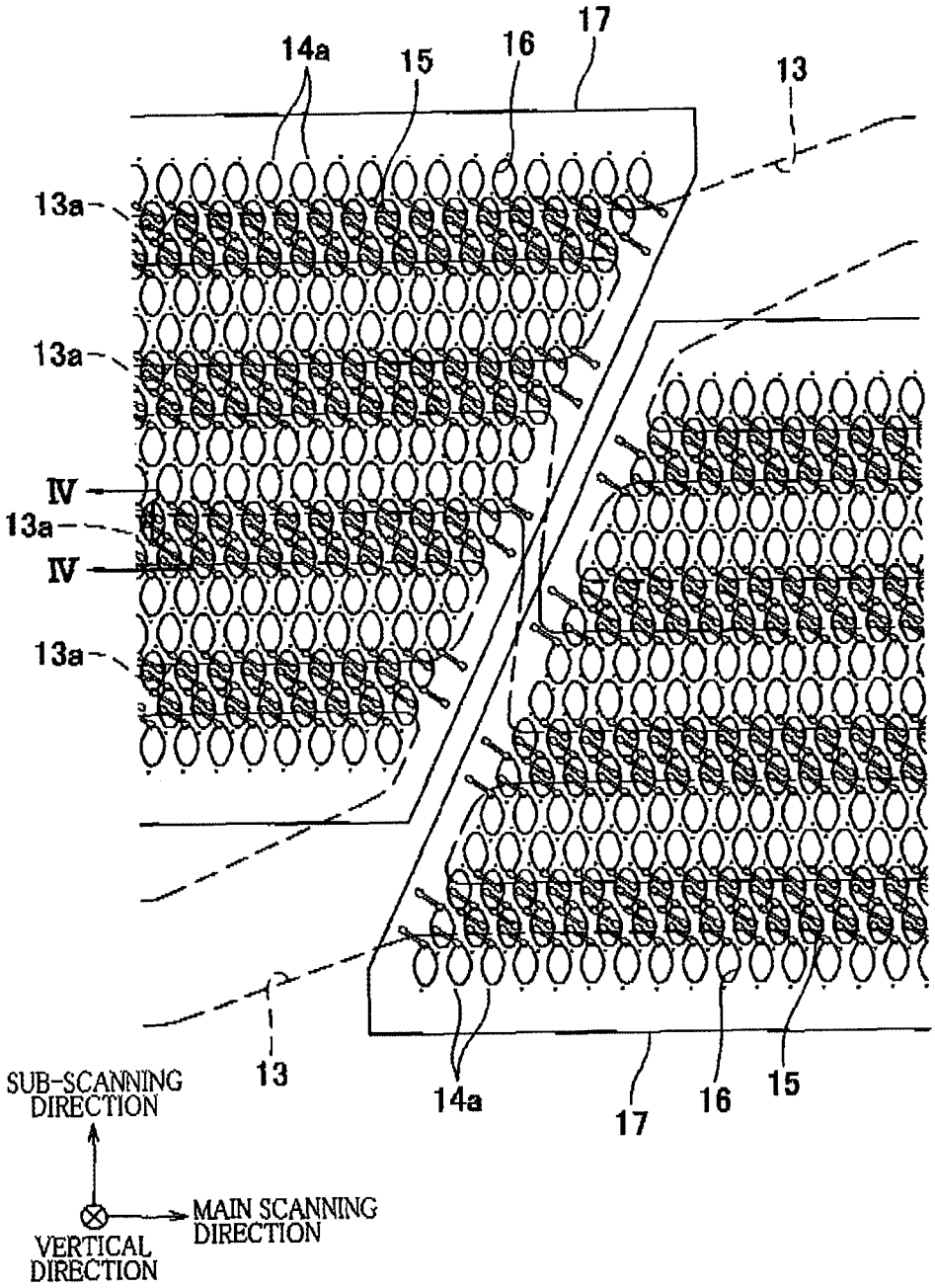
FIG. 3 is an enlarged view illustrating area III enclosed by one-dot chain line in FIG. 2.
Figure 4:
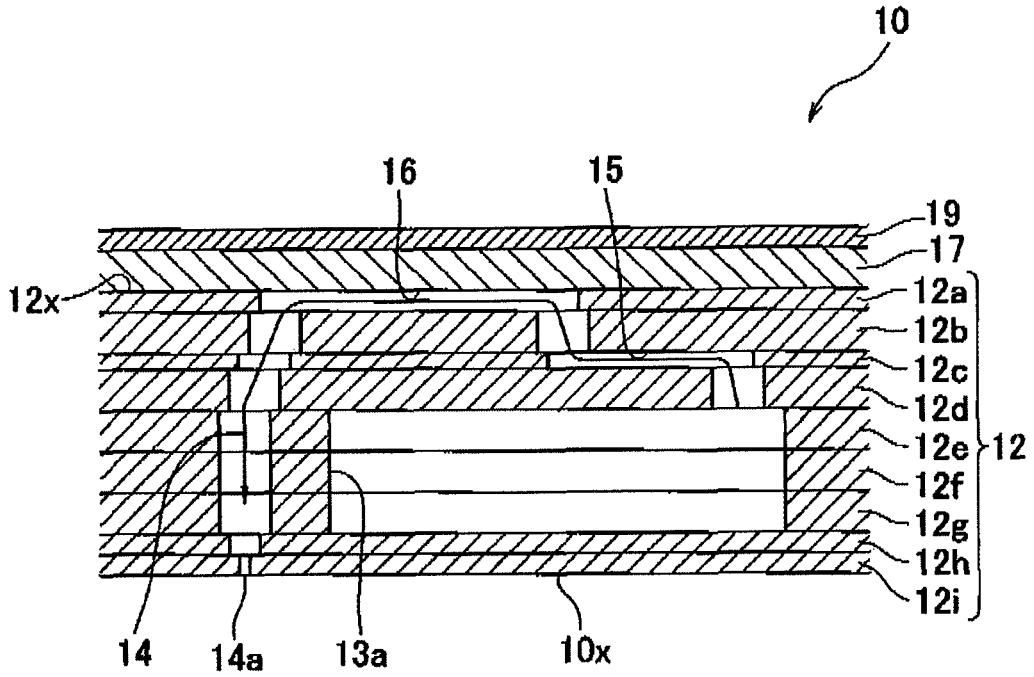
FIG. 4 is a cross-sectional view taken along line IV-IV in FIG. 3.

There will be next explained the construction of the head 10 with reference to FIGS. 2-4. It is noted that, in FIG. 3, pressure chambers 16 and apertures 15 are illustrated by solid lines for easier understanding purposes though these elements are located under actuator units 17 and thus should be illustrated by broken lines.

The head 10 includes a passage unit 12, a reservoir unit, the eight actuator units 17, eight flexible printed circuits (FPCs) 19, and a circuit board.

The passage unit 12 is a stacked body constituted by nine metal plates 12*a*-12*i* having generally the same size, and passages are formed in the passage unit 12. These passages include manifold passages 13, sub-manifold passages 13*a*, and individual passages 14. An upper surface 12*x* of the passage unit 12 has openings 12*y*. Each of the manifold passages 13 has a corresponding one of the openings 12*y* at its one end. Each of the sub-manifold passages 13*a* is branched off from a corresponding one of the manifold passages 13. The individual passages 14 are provided respectively for the ejection openings 14*a* and respectively extend from outlets of the sub-manifold passages 13*a* to the ejection openings 14*a* via the pressure chambers 16 and the apertures 15 each as a restrictor for adjusting a passage resistance. A lower surface of the passage unit 12 which opposes the upper surface 12*x* is the ejection surface 10*x*.

The pressure chambers 16 are formed for and connected to the respective ejection openings 14*a*. An opening of each pressure chamber 16 has a generally rhombic shape and is formed in a predetermined area on a corresponding one of the actuator units 17 provided on the upper surface 12*x* such that the pressure chambers 16 are arranged in matrix (see FIG. 3). In areas on a lower surface (i.e., the ejection surface 10*x*) of the head 10 which oppose the predetermined areas of the respective actuator units 17, the ejection openings 14*a* are arranged in matrix in the same configuration as that of the pressure chambers 16.

The reservoir unit has a passage including a reservoir. The reservoir temporarily stores the ink supplied from the cartridge. This passage is coupled at its one end to a cartridge by a tube, for example, and at the other end to the passages of the passage unit 12. Protruding portions and recessed portions are formed on and in a lower surface of the reservoir unit. Distal end faces of the respective protruding portions are fixed to the upper surface 12*x* at areas not overlapping the actuator units 17 (i.e., areas including the openings 12*y* which are enclosed by two-dot chain lines in FIG. 2). Passages connected to the reservoir are open in the distal end faces of the respective protruding portions. The recessed portions oppose to the upper face 12*x*, faces of the actuator units 17, and faces of the FPCs 19 with a small space therebetween.

As illustrated in FIG. 2, the eight actuator units 17 are fixed to the upper surface 12*x* so as to be arranged in two arrays in a staggered configuration in the main scanning direction. Each of the actuator units 17 has a trapezoid shape as its outer shape and covers the openings of the corresponding pressure chambers 16 formed in the predetermined area of the respective actuator unit 17. Each actuator unit 17 is constituted by piezoelectric layers, a common electrode, and individual electrodes. Each of the piezoelectric layers and the common electrode has a trapezoid shape which defines the outer shape of the actuator unit 17. The individual electrodes are provided for the respective pressure chambers 16 and arranged on an upper surface of the piezoelectric layer at areas respectively opposing the pressure chambers 16 in the vertical direction. A portion of the actuator units 17 which is sandwiched between each of the individual electrodes and a corresponding one of the pressure chambers 16 functions as an individual piezoelectric actuator for the pressure chamber 16. The actuators are deformable independently of each other. When a drive voltage is applied to each of the actuators via a corresponding one of the FPCs 19, the actuator makes unimorph deformation to change a volume of the corresponding pressure chamber 16. This change in volume applies energy to the ink in the pressure chamber 16, causing the ink to be ejected from a corresponding one of the ejection opening 14*a*.

The eight FPCs 19 are connected respectively to the eight actuator units 17. Each of the FPCs 19 is fixed at its one end to a corresponding one of the actuator units 17 and fixed at the other end to the circuit board. Each FPC 19 includes wirings and terminals corresponding to the electrodes of the corresponding actuator unit 17, and a driver IC is mounted on the FPC 19 between the actuator unit 17 and the circuit board. The wirings are connected to an output terminal of the driver IC. The circuit board adjusts a signal input from the controller 1*p* and outputs the adjusted signal to the driver IC through the wiring of the FPC 19. The driver IC converts this signal to a drive signal and transmits this drive signal to the electrodes of the actuator units 17 through the wirings of the FPC 19.

Figure 6:
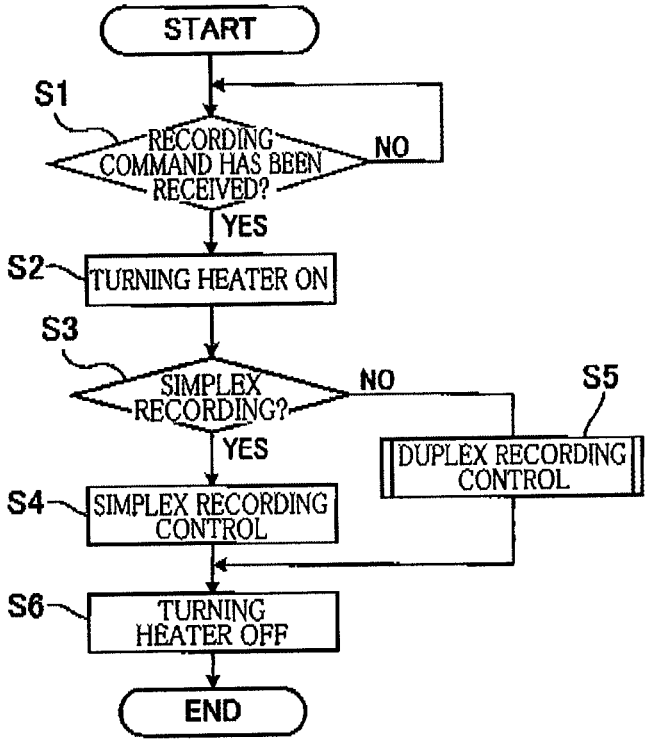
FIG. 6 is a flow chart illustrating control executed by a controller of the printer.
Figure 7:
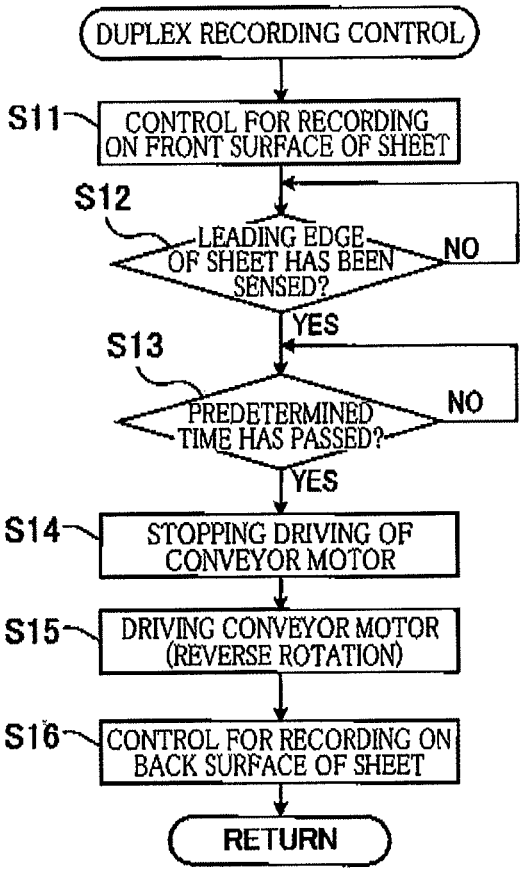
FIG. 7 is a flow chart illustrating duplex recording control in FIG. 6.

There will be next explained control of the controller 1*p* with reference to FIGS. 6 and 7.

The routine illustrated in FIG. 6 begins with S1 at which the controller 1*p* determines whether a recording command has been received from the external device or not. When the recording command has not been received (S1: NO), the controller 1*p* repeats the processing at S1. When the recording command is received (S1: YES), the controller 1*p* at S2 turns on the heater 26*ah*. The controller 1*p* at S3 refers to the recording command to determine whether the recording command indicates the simplex recording or not.

In the case of the simplex recording (53: YES), the controller 1*p* at S4 executes control for the simplex recording. Specifically, the controller 1*p* controls the sheet-supply motor 1*c*M, the conveyor motor 20M, and the head 10 such that the uppermost sheet P in the sheet-supply tray 1*c*1 is supplied by the sheet-supply unit 1*c* and conveyed in the first direction D1 to the recording position P1 where an image is recorded on a surface of the sheet P, and thereafter the sheet P is discharged from the opening 30 onto the sheet-output portion 31.

In the case of the duplex recording (S3: NO), the controller 1*p* at S5 executes control for the duplex recording. In this duplex recording control, as illustrated in FIG. 7, the controller 1*p* initially at S11 executes control for recording on a front surface of the sheet P. Specifically, the controller 1*p* controls the sheet-supply motor 1*c*M, the conveyor motor 20M, and the head 10 such that the uppermost sheet P in the sheet-supply tray 1*c*1 is supplied by the sheet-supply unit 1*c* and conveyed in the first direction D1 to the recording position P1 where an image is recorded on the front surface of the sheet P.

The controller 1*p* at S12 determines based on signals output from the sensor 32 whether a downstream edge portion of the sheet P in the first direction D1 (i.e., a leading edge of the sheet P in the first direction D1) has reached the sensing portion P2 or not. The controller 1*p* determines that the leading edge of the sheet P has reached the sensing position P2, at the timing when the signal output from the sensor 32 is changed from a signal indicative of the absence of the sheet P to a signal indicative of the presence of the sheet P. When the leading edge of the sheet P has not reached the sensing position P2 (S12: NO), the controller 1*p* repeats the processing at S12.

When the leading edge of the sheet P has reached the sensing position P2 (S12: YES), the controller 1*p* at S13 refers to a timer to determine whether or not a predetermined length of time T has passed from the sense of the sensor 32, i.e., the timing when the leading edge of the sheet P had reached the sensing position P2. The predetermined length of time T may be determined in any method based on a design value and/or an actual measurement value. One example of the calculation of the predetermined length of time T will be explained later.

When the predetermined length of time T has passed from the timing when the leading edge of the sheet P had reached the sensing position P2 (S13: YES), the controller 1*p* at S14 outputs a command for stopping the driving of the conveyor motor 20M. After the driving of the conveyor motor 20M is completely stopped, and thereby the rotations of the roller pairs 26, 27 are completely stopped, the controller 1*p* at S15 outputs a command for rotating the conveyor motor 20M in the reverse direction. As a result, the roller pairs 26, 27 are rotated in the reverse direction to convey the sheet P in the second direction D2.

After S15, the controller 1*p* at S16 executes control for image recording on a back surface of the sheet P. Specifically, the controller 1*p* controls the conveyor motor 20M and the head 10 such that the sheet P conveyed by the second conveyor 20*b* in the second direction D2 is conveyed by the third conveyor 20*c* so as to enter into the conveyance path of the first conveyor 20*a* and is then conveyed by the first conveyor 20*a* again in the first direction D1 to the recording position P1 where an image is recorded on the back surface of the sheet P, and thereafter the sheet P is discharged from the opening 30 onto the sheet-output portion 31.

After S16, the controller 1*p* finishes this routine and executes the processing at S6 in FIG. 6. After S4 and S5, the controller 1*p* at S6 tarns off the heater 26*ah*, and this routine ends.

During the processings at S2-S6, the controller 1*p* executes ON-OFF control for the heater 26*ah* to keep the temperature of the roller 26*a* within a predetermined range that is appropriate for drying the sheet P. Specifically, each time when a predetermined length of time A has passed, the controller 1*p* determines whether or not the temperature of the roller 26*a* is equal to or higher than a predetermined temperature B, based on a signal output from a sensor for sensing the temperature of the roller 26*a*. When the temperature of the roller 26*a* is lower than the predetermined temperature B, the controller 1*p* turns on the heater 26*ah*. When the temperature of the roller 26*a* is equal to or higher than the predetermined temperature B, the controller 1*p* turns off the heater 26*ah*.

It is noted that the control for the temperature of the roller 26*a* is not limited to the ON-OFF control described above. Other examples of the control for the temperature of the roller 26*a* include: control using proportional, integral, or derivative values; and proportional-integral-derivative control (PID control) using proportional, integral, and derivative values in combination. Also, the predetermined temperature B may be set at any suitable value. The predetermined temperature B is preferably set at a temperature that is appropriate for drying the sheet P in a second processing of the simplex recording (i.e., a period before the sheet P is discharged to an outside of the housing 1*a*) and appropriate for drying the sheet P in a period before the image recording is performed on the back surface of the sheet P in the duplex recording (i.e., before a fourth processing). The predetermined temperature B may be the same temperature or different temperatures in the simplex recording and the duplex recording. Also, the predetermined temperature B may be determined according to a type of a recording medium, an image to be recorded on the sheet P, and so on.

Since the temperature of the roller 26*a* is thus kept within the predetermined range, the sheet P is dried at the drying position P3 by heat applied to the portion of the sheet P which is nipped by the roller pair 26 in any of the simplex recording control (S4) and the duplex recording control (S5).

The predetermined length of time A, the predetermined temperature B, and the predetermined length of time T are stored in the ROM of the controller 1*p*.

There will be next explained, with reference to FIG. 8, one example of the calculation of the predetermined length of time T and changes in speed (an absolute value of velocity) at which the sheet P is conveyed (hereinafter may be referred to as "sheet conveying speed") in a process in which a direction in which the sheet P is conveyed (hereinafter may be referred to as "sheet conveying direction") is switched from the first direction D1 to the second direction D2 in the duplex recording.

Figure 8:
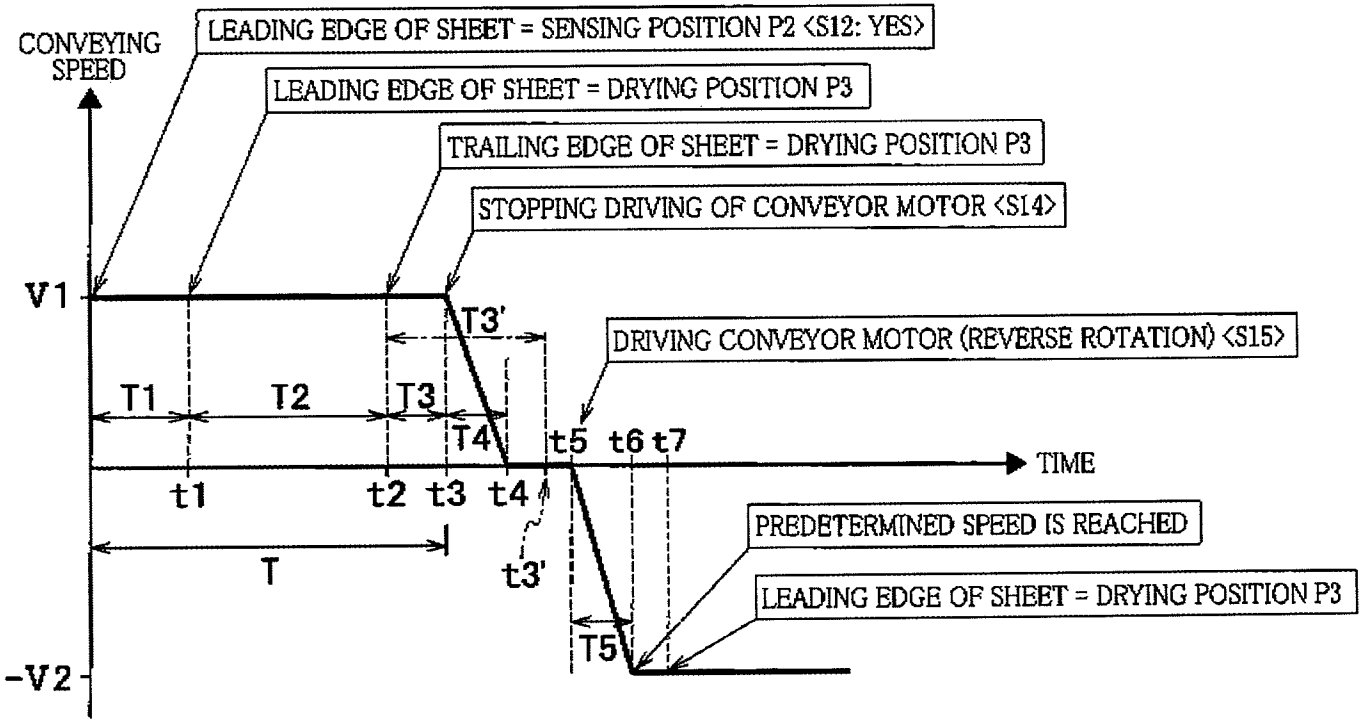
FIG. 8 is a graph illustrating changes in sheet conveying speed in the process of switching a sheet conveying direction from a first direction to a second direction in duplex recording.

In FIG. 8, the vertical axis represents the sheet conveying speed at which the roller pair 27 conveys the sheet P, and the horizontal axis represents a time elapsed. The conveying speed is determined by a speed of rotation of the drive roller and the diameter of the drive roller. The conveying speed at which the sheet P is conveyed in the first direction D1 is represented by a positive value, and the conveying speed at which the sheet P is conveyed in the second direction D2 is represented by a negative value. The roller pairs 26, 27 are rotated such that the sheet P is conveyed at the speed V1 in the first direction D1 and at the speed V2 (which is greater than the speed V1) in the second direction D2. The time point t0 is a point in time when the leading edge of the sheet P reaches the sensing position P2 or when a positive decision (YES) is made at S12. The time point t1 is a point in time when the leading edge of the sheet P reaches the drying position P3. The time point t2 is a point in time when an upstream edge portion of the sheet P in the first direction D1 (i.e., a trailing edge of the sheet P conveyed in the first direction D1) reaches the drying position P3. The time point t3 is a point in time when the controller 1*p* outputs the command for stopping the driving of the conveyor motor 20M (at S14) or when the conveying speed starts decreasing from the speed V1. The time point t3' is a point in time when the trailing edge of the sheet P reaches a most downstream nipping point P4 in a case where the conveying speed V1 is kept to the time point t3' without the output of the command for stopping the driving of the conveyor motor 20M at the time point t3. The most downstream nipping point P4 is a position at which the roller pair 27 nips the sheet P. The time point t4 is a point in time when the rotations of the roller pairs 26, 27 are completely stopped, and the conveying speed becomes zero after the time point t3. The time point t5 is a point in time when the controller 1*p* outputs the command for rotating the conveyor motor 20M in the reverse direction (at S15) or when the roller pair 26 starts rotating in the reverse direction, and the conveying speed starts increasing (in the negative direction or the down direction in FIG. 8). The time point t6 is a point in time when the conveying speed finishes increasing, and the conveying speed becomes constant at the speed V2 after the time point t5. The time point t7 is a point in time when the leading edge of the sheet P conveyed in the second direction D2 (i.e., a downstream edge of the sheet P in the second direction D2) reaches the drying position P3. The time T1 is a length of time extending from the time point t0 to the time point t1, the time T2 is a length of time extending from the time point t1 to the time point t2, the time T3 is a length of time extending from the time point t2 to the time point t3, the time T3' is a length of time extending from the time point t2 to the time point t3', the time T4 is a length of time extending from the time point t3 to the time point t4, and the time T5 is a length of time extending from the time point t5 to the time point t6.

The predetermined length of time T is calculated, for example, by the following Equations (1) and (2):

$$T=T1+T2+T3 \tag{1}$$

$$\alpha \leq T3 \leq T3'-T4 \tag{2}$$

In a case where a distance L1 by which the sheet P is conveyed during the time T4 is equal to or longer than a distance L2 by which the sheet P is conveyed during the time T5, the value α is zero, and in a case where the distance L1 is shorter than the distance L2, the value α is a length of time in which the sheet P is conveyed at the speed V1 by a distance obtained by subtracting the distance L1 from the distance L2 (L2−L1). In other words, the distance L1 is a distance by which the sheet P is conveyed in a period from the time point t3 at which the conveying speed starts decreasing from the speed V1 to the time point t4 at which the rotations of the roller pairs 26, 27 are completely stopped, and the conveying speed becomes zero. The distance L2 is a distance by which the sheet P is conveyed in a period from the time point t5 at which the roller pair 26 starts rotating in the reverse direction, and the conveying speed starts increasing (in the negative direction or the down direction in FIG. 8), to the time point t6 at which the conveying speed becomes constant at the speed V2.

The time T1 is a length of time extending from the time point t0 at which the leading edge of the sheet P reaches the sensing position P2 to the time point t1 at which the leading edge of the sheet P reaches the drying position P3. The time T1 is calculated by dividing the length of the conveyance path from the sensing position P2 to the drying position P3, by the conveying speed V1. The time T2 is a length of time extending from the time point t1 at which the leading edge of the sheet P reaches the drying position P3, to the time point t2 at which the trailing edge of the sheet P reaches the drying position P3. The time T2 is calculated by dividing the length of the sheet P in the conveying direction, by the conveying speed V1. In the present embodiment, this calculation uses the length of the sheet P of the largest size conveyed in the printer 1. The time T1+T2 is a length of time extending from the time point t0 at which the leading edge of the sheet P reaches the sensing position P2, to the time point t2 at which the trailing edge of the sheet P reaches the drying position P3. The time T3' is a length of time extending from the time point t2 at which the trailing edge of the sheet P reaches the drying position P3 to the time point t3' at which the trailing edge of the sheet P reaches the most downstream nipping point P4 in the case where the command for stopping the driving of the conveyor motor 20M is not output at the time point t3, and the conveying speed V1 is kept. The time T3' is calculated by dividing the length of the conveyance path from the drying position P3 to the most downstream nipping point P4, by the conveying speed V1. The time T4 is a length of time extending from the point in time when the controller 1*p* outputs the command for stopping the driving of the conveyor motor 20M (at S14), i.e., from the time point t3 at which the conveying speed starts decreasing from the speed V1, to the time point t4 at which the rotations of the roller pairs 26, 27 are completely stopped, and the conveying speed becomes zero after the time point t3. The time T4 may be an acceleration or deceleration time of the conveyor motor 20M, may be obtained by calculation using acceleration of the roller pairs 26, 27, and may be obtained based on an actual measurement value. Each of the distance L1 and the distance L2 may be obtained by calculation using the acceleration of the roller pairs 26, 27 and may be obtained based on an actual measurement value obtained by a result of image-taking of a high-speed camera, for example. Each of the acceleration and the actual measurement value for the time T4 may be obtained based on the actual measurement value obtained by the result of image-taking of the high-speed camera, for example.

Here, in the case where the distance L1 is equal to or longer than the distance L2, the predetermined length of time T can be expressed by the following Equation (3) based on Equations (1) and (2).

$$T1+T2 \leq T \leq T1+T2+T3'-T4 \tag{3}$$

The predetermined length of time T is a length of time extending from the point in time when the leading edge of the sheet P conveyed in the first direction D reaches the sensing position P2, to a point in time that is after the trailing edge of the sheet P conveyed in the first direction D reaches the drying position P3 and that is the time T4 (i.e., the length of time extending from the start of decrease of the conveying speed of the roller pairs 26, 27 to the stop of the roller pairs 26, 27) before the time point t3' (at which the trailing edge of the sheet P reaches the most downstream nipping point P4 where the sheet P is conveyed at the constant velocity V1). The reason why the end of the predetermined length of time T is defined at the point in time that is in advance of the time T4 before the time point t3' is that if the end of the predetermined length of time T is after the trailing edge of the sheet P reaches the most downstream nipping point P4 when the rotations of the roller pairs 26, 27 are stopped, the sheet P is not nipped by the roller pair 27 when the rotations of the roller pairs 26, 27 are stopped. In the case where the trailing edge of the sheet P is not nipped by the roller pair 27, the sheet P has been discharged onto the sheet-output portion 31, and even if the roller pairs 26, 27 are rotated in the reverse direction, the sheet P is not conveyed in the second direction D2. Since the above-described predetermined length of time T is set in the present embodiment, however, the conveying speed decreases after the trailing edge of the sheet P passes through the drying position P3, eliminating unevenness in drying the sheet P conveyed in the first direction D1. Also, the conveying speed is constant at the speed V2 before the leading edge of the sheet P in the second direction D2 reaches the drying position P3, eliminating unevenness in drying the sheet P conveyed in the second direction D2.

In the case where the distance L1 is shorter than the distance L2, the predetermined length of time T can be expressed by the following Equation (4) based on Equations (1) and (2).

$$T1+T2+\alpha \leq T \leq T1+T2+T3'-T4 \quad (4)$$

The predetermined length of time T is a length of time extending from the point in time when the leading edge of the sheet P reaches the sensing position P2, to a point in time that is after a lapse of time α starting from the timing when the trailing edge of the sheet P reaches the drying position P3 and that is the time T4 (i.e., the length of time extending from the start of decrease of the conveying speed of the roller pairs 26, 27 to the stop of the roller pairs 26, 27) before the time point t3' (at which the trailing edge of the sheet P reaches the most downstream nipping point P4 where the sheet P is conveyed at the constant velocity V1). In this setting of the predetermined length of time T, the conveying speed decreases after a lapse of time α starting from the timing when the trailing edge of the sheet P passes through the drying position P3, eliminating unevenness in drying the sheet P conveyed in the first direction D1. Also, the conveying speed is constant at the speed V2 before the trailing edge of the sheet P reaches the drying position P3, eliminating unevenness in drying the sheet P conveyed in the second direction D2. That is, in the case where the distance L1 is shorter than the distance L2, if the predetermined length of time T is set at the time T1+T2, the conveying speed becomes constant at the speed V2 after the point in time when the leading edge of the sheet P conveyed in the second direction D2 reaches the drying position P3 with the roller pairs 26, 27 being rotated in the reverse direction, leading to unevenness in drying (i.e., a degree of drying) the sheet P conveyed in the second direction D2. Thus, in the case where the distance L1 is shorter than the distance L2, the predetermined length of time T is set based on Equation (4) in the present embodiment, eliminating unevenness in drying both the sheet P conveyed in the first direction D1 and the sheet P conveyed in the second direction D2.

Since the predetermined length of time T is set as described above, when the conveying direction is switched from the first direction D1 to the second direction D2 in the duplex recording, the sheet P is temporarily stopped when the trailing edge of the sheet P conveyed in the first direction D1 is located between the drying position P3 and the most downstream nipping point P4 (i.e., on a downstream side of the drying position P3 in the first direction D1 and an upstream side of the most downstream nipping point P4 in the first direction D1), and the sheet P is thereafter conveyed in the second direction D2.

In the present embodiment, the processing at S11 is one example of a first processing, the processings at S12-S14 are one example of a second processing, the processing at S15 is one example of a third processing, and the processing at S16 is one example of the fourth processing.

In the present embodiment as described above, the sheet P is dried and conveyed until the trailing edge of the sheet P conveyed in the first direction D1 reaches a position located downstream of the drying position P3 in the first direction D1 in the second processing (S12-S14), and the sheet P is thereafter conveyed in the second direction D2 in the third processing (S15). As a result, the entire sheet P can be dried without unevenness. That is, it is possible to reduce an amount of unevenness in a degree of drying of the sheet P.

In the second processing (S12-S14), as illustrated in FIG. 8, the controller 1*p* controls the second conveyor 20*b* such that the sheet conveying speed starts decreasing after at least an upstream edge portion of an image-recorded area on the front surface of the sheet P in the first direction D1 (in the present embodiment, the trailing edge of the sheet P) passes through the drying position P3. If the sheet conveying speed starts decreasing before the trailing edge of the image-recorded area passes through the drying position P3 in the second processing, unevenness occurs in the degree of dryness in the image-recorded area, leading to a low image quality. However, the above-described configuration can reduce an amount of lowering of the image quality.

In addition, the trailing edge of the sheet P conveyed in the first direction D1 is used as a reference in the above-described control in the present embodiment. Accordingly, the above-described effects can be obtained with simple control when compared with a case where the trailing edge of the image-recorded area is used as a reference.

In the third processing (S15), as illustrated in FIG. 8, the controller 1*p* controls the second conveyor 20*b* such that the increase in the sheet conveying speed is finished, and the sheet conveying speed becomes constant before at least the downstream edge portion of the image-recorded area on the front surface of the sheet P in the second direction D2 (in the present embodiment, the leading edge of the sheet P conveyed in the second direction D2) passes through the drying position P3. In the third processing, if the sheet conveying speed is not constant but continues increasing when the leading edge of the image-recorded area passes through the drying position P3, unevenness occurs in the degree of dryness in the image-recorded area, leading to a low image quality. However, the above-described configuration can reduce an amount of lowering of the image quality.

In addition, the leading edge of the sheet P conveyed in the second direction D2 is used as a reference in the above-described control in the present embodiment. Accordingly, the above-described effects can be obtained with simple control when compared with the case where the leading edge of the image-recorded area is used as a reference.

Based on the signals output by the sensor 32, the controller 1*p* controls the second conveyor 20*b* to change the sheet conveying speed. Accordingly, the above-described effects can be obtained with simple control.

The controller 1*p* controls the heater 26*ah* to dry the sheet P in both of the second processing (S12-S14) and the third processing (S15). Insufficient dying of the sheet P causes the ink to stick to components constituting the third conveyor 20*c* and the first conveyor 20*a* in the fourth processing (S16). In the present embodiment as described above, the sheet P is dried in both of the second processing and the third processing, increasing the degree of dryness of the sheet P to address this problem.

It is possible to consider that electric power for driving the heater 26*ah* is increased in the second processing to sufficiently dry the sheet P in a configuration in which the sheet P is dried only in the second processing. It is assumed in this configuration that the sheet P is dried with the same drive power also in the second processing in the simplex recording (i.e., before the sheet P is discharged to the outside of the housing 1*a*). However, there is a low possibility that the sheet P is nipped firmly by, e.g., components constituting the conveyor after the sheet P is discharged to the outside of the housing 1*a*. On the other hand, the sheet P conveyed by the third conveyor 20*c* is nipped by the roller pairs constituting the third conveyor 20*c* and the roller pairs constituting the first conveyor 20*a*. Thus, insufficient drying of the sheet P causes the ink to stick to the roller pairs constituting the third conveyor 20*c* and the first conveyor 20*a* in particular. If the ink has sticked to the roller pairs constituting the third conveyor 20*c* and the first conveyor 20*a*, the ink may stick to a sheet P conveyed next. Accordingly, in the second processing in the simplex recording, the degree of dryness of the sheet P can be set low when compared with a period before image recording is performed on the back surface of the sheet P in the duplex recording (i.e., before the fourth processing). That is, the degree of dryness of the sheet P to be discharged to the outside of the housing 1*a* may be set at a low value when compared with the sheet P conveyed by the third conveyor 20*c*. If the heater 26*ah* is driven by great drive power in the second processing in the simplex recording in spite of this circumstance, consumption of electric power becomes larger than necessary, resulting in higher cost. In the configuration in which the sheet P is dried in both of the second processing and the third processing, the degree of dryness of the sheet P conveyed by the third conveyor 20*c* can be increased with lower consumption of electric power.

Also, the first conveyor 20*a* is configured to convey the sheet P to the recording position. The second conveyor 20*b* is configured to convey the image-recorded sheet P to the sheet-output portion 31 or the third conveyor 20*c*, and the third conveyor 20*c* is configured to convey the image-recorded sheet P to the first conveyor 20*a*. Thus, the first conveyor 20*a* needs high conveying accuracy when compared with the second conveyor 20*b* and the third conveyor 20*c*. In other words, the first conveyor 20*a* needs a high conveying force when compared with the second conveyor 20*b* and the third conveyor 20*c*. Accordingly, the nip pressure of each roller pair of the first conveyor 20*a* is preferably higher than that of each roller pair of the second conveyor 20*b* and the third conveyor 20*c*. Alternatively, the area of contact between the rollers of each roller pair of the first conveyor 20*a* is preferably larger than that between the rollers of each roller pair of the second conveyor 20*b* and the third conveyor 20*c*. For example, one of the rollers of each roller pair of the second conveyor 20*b* and the third conveyor 20*c*, which one is to contact the first surface of the recording medium, may be constituted by a spur for reducing the area of contact with the sheet P. In this configuration, drying the sheet P in both of the second processing (S12-S14) and the third processing (S15) can reduce an amount of ink transferring to the roller pairs of the first conveyor 20*a* when the image-recorded sheet P is conveyed. On the other hand, each roller pair of the second conveyor 20*b* and the third conveyor 20*c* has a reduced conveying force, preventing the transfer of the ink.

The controller 1*p* controls the roller pairs 26, 27 in the second processing (S12-S14) and the third processing (S15) such that the rotational speeds of the respective roller pairs 26, 27 are different from each other (see V1 and V2 in FIG. 8), so that the sheet conveying speed is different from each other between the second processing and the third processing. As a result of this control, an amount of heat supplied to the sheet P by the dryer 50 is different between the second processing and the third processing. Therefore, the degree of dryness of the sheet P can be adjusted appropriately for each of the simplex recording and the duplex recording.

In addition, the controller 1*p* controls not the dryer 50 but the second conveyor 20*b* to generate different amounts of heat in the present embodiment. In this configuration, the above-described effects can be more reliably obtained with simpler control than in a configuration in which the controller 1*p* controls the dryer 50 to generate different amounts of heat.

In the present embodiment, the speed V2 is greater than the speed V1, and the sheet conveying speed is higher in the third processing than in the second processing. This configuration allows high-speed recording.

The dryer 50 includes: the forward/reverse rotatable roller pair 26 partly constituting the second conveyor 20*b* and rotatable forwardly and reversely; and the heater 26*ah* for heating one of the two rollers 26*a*, 26*b* constituting the roller pair 26, in the present embodiment, the roller 26*a*, resulting in simple configuration when compared with a configuration in which a heater is provided additionally.

The second conveyor 20*b* includes the forward/reverse rotatable roller pair 27 rotatable forwardly and reversely and disposed downstream of the drying position P3 in the first direction D1. This configuration enables stable conveyance of the sheet P in the second direction D2.

The dryer 50 includes the roller 26*a* that is the contact member for applying heat to the sheet P in the state in which the roller 26*a* contacts at least the front surface of the sheet P. The front surface of the sheet P needs to be dried in particular because the ink may stick to the components of the third conveyor 20*c* and the fast conveyor 20*a* in the fourth processing (S16) due to contact of the front surface of the sheet P with the components of the third conveyor 20*c* and the first conveyor 20*a*. In the above-described configuration, the front surface can be dried sufficiently, reliably preventing the ink from sticking to the components of the third conveyor 20*c* and the first conveyor 20*a*.

To prevent the ink from sticking to the back surface of the sheet P, spur rollers or other similar components can be used as components which constitute the third conveyor 20*c* and the first conveyor 20*a* and contact the back surface. Accordingly, problems are less caused on the back surface of the sheet P due to insufficient drying when compared with the front surface of the sheet P.

Figure 9:
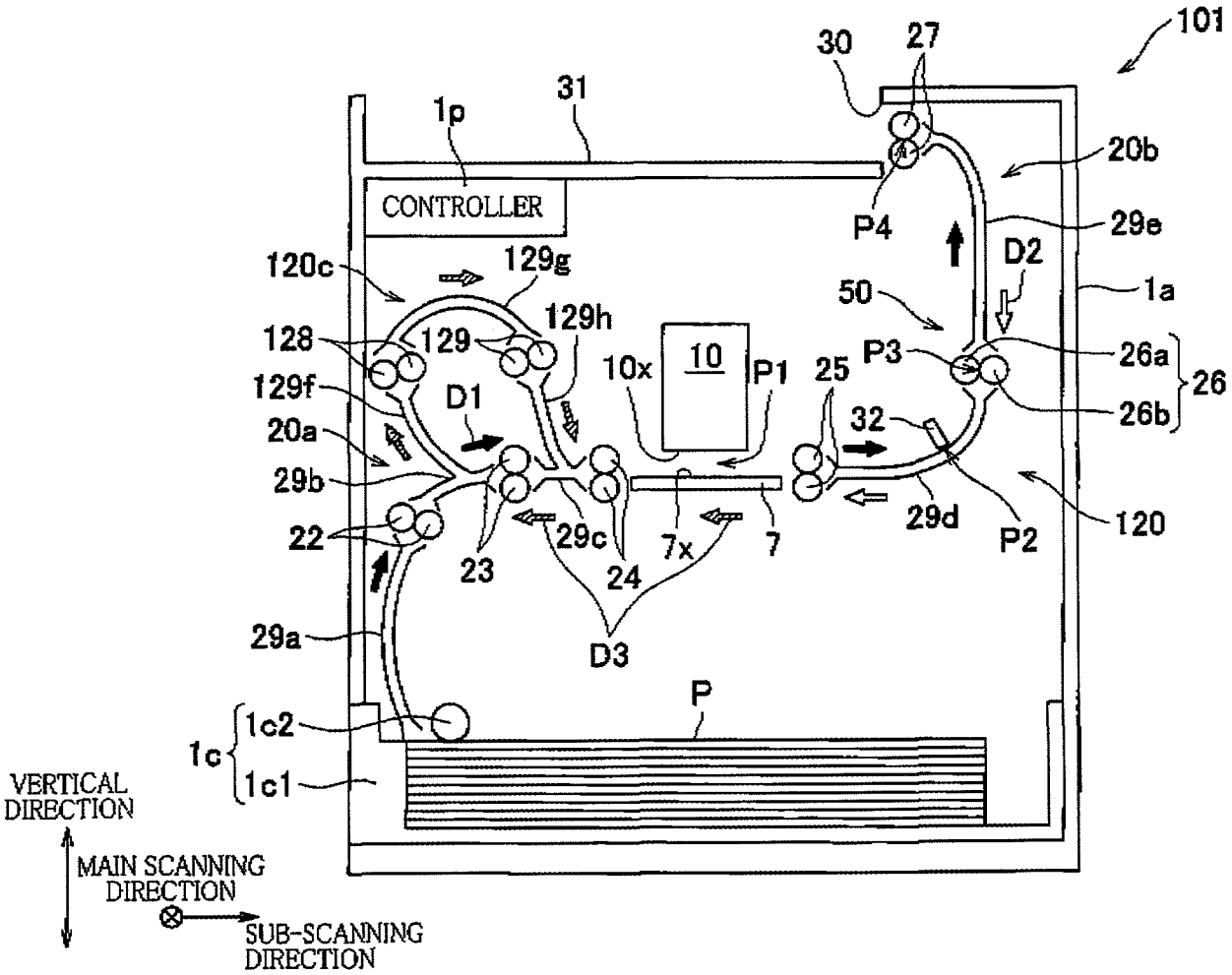
FIG. 9 is a schematic side view illustrating an internal structure of an inkjet printer according to a second embodiment of the present invention.

There will be next explained an ink-jet printer 101 according to a second embodiment of the present invention with reference to FIG. 9.

The printer 101 is similar in construction to the printer 1 according to the first embodiment except for a conveyor unit. It is noted that the same reference tags as used in the first embodiment are used to designate the corresponding elements of the second embodiment, and an explanation of which is dispensed with.

In this embodiment, a conveyor unit 120 includes the first conveyor 20*a*, the second conveyor 20*b*, and a third conveyor 120*c*. The third conveyor 120*c* conveys the sheet P conveyed in the second direction D2 by the second conveyor 20*b*, along hatched arrows D3 in FIG. 9 to a position located upstream of the recording position P1 in the first direction D1 (i.e., the position near the roller pair 24 on an upstream side thereof), so as to return the sheet P into the sheet conveyance path of the first conveyor 20*a*. The third conveyor 120*c* includes the roller pairs 23, 24 of the first conveyor 20; the roller pair 25 of the second conveyor 20*b*, roller pairs 128, 129, and guides 129*f*-129*h*.

In the present embodiment, not only the roller pairs 26, 27 but also the roller pairs 23-25 are forward/reverse rotatable roller pairs rotatable forwardly and reversely. When the command for rotating the conveyor motor 20M in the reverse direction is output at S15, the roller pairs 23-27 are rotated in the reverse direction. As a result, the sheet P is conveyed by the second conveyor 20*b* in the second direction D2 into the third conveyor 20*c* in which the sheet P is conveyed along the arrow D3 while being nipped by the roller pairs 25, 24, 23, 128, 129 in order and returned into the conveyance path of the first conveyor 20*a*.

The printer 101 according to the second embodiment differs from the printer 1 according to the first embodiment in the conveyance path but can obtain the same effects as obtained in the printer 1 due to its configuration similar to that of the printer 1.

There will be next explained an ink-jet printer according to a third embodiment of the present invention.

Figure 10:
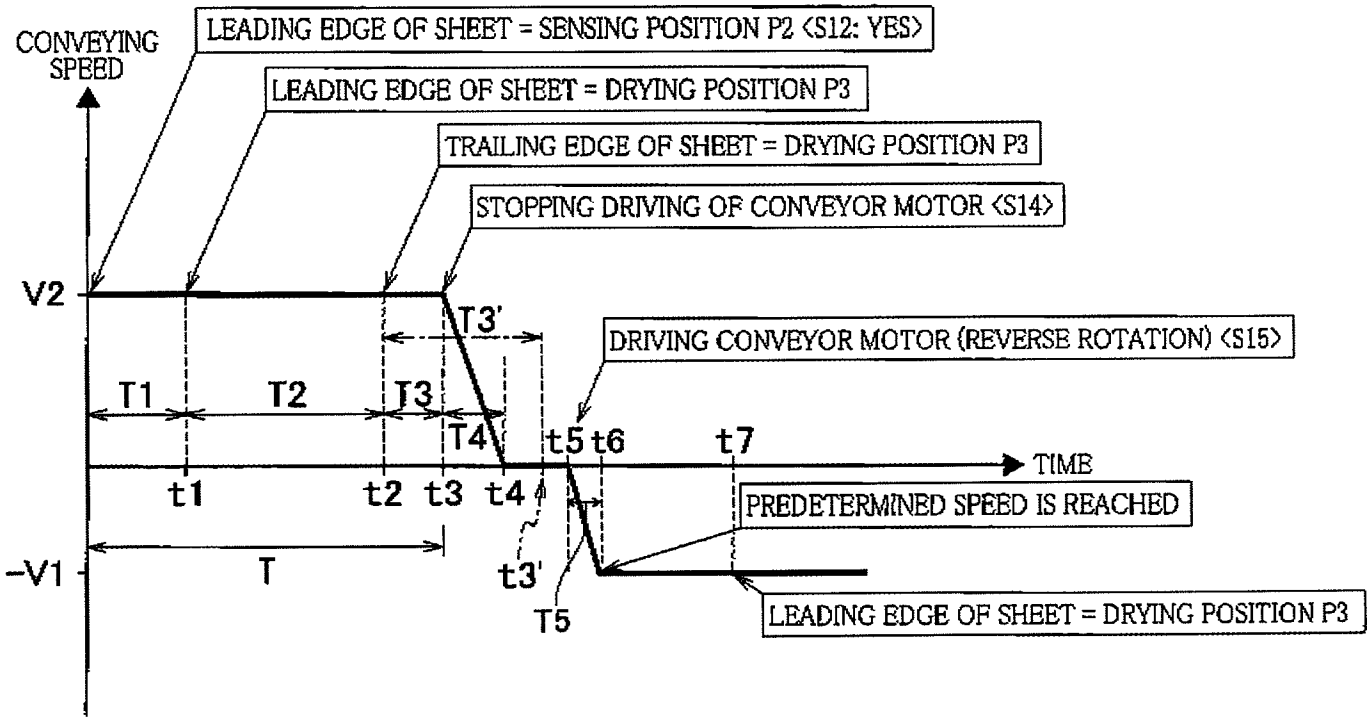
FIG. 10 is a graph illustrating changes in sheet conveying speed in the process of switching the sheet conveying direction from the first direction to the second direction in duplex recording in an ink-jet printer according to a third embodiment of the present invention.

As illustrated in FIG. 10, the printer according to the present embodiment differs from the printer 1 according to the first embodiment only in that the sheet conveying speed in the second processing (S12-S14) is set at the speed V2, and the sheet conveying speed in the third processing (S15) is set at the speed V1 that is lower than the speed V2. That is, in the present embodiment, the controller 1*p* controls the second conveyor 20*b* such that the sheet conveying speed is less in the third processing than in the second processing.

The printer according to the third embodiment differs from the printer 1 according to the first embodiment in the control of the rotational speed of the roller pairs 26, 27 but can obtain the same effects as obtained in the printer 1 due to its configuration similar to that of the printer 1.

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

The roller of the dryer may be any of a drive roller and a driven roller. The dryer may have any configuration as long as the dryer can reduce an amount of water contained in the recording medium. For example, the dryer may be constituted by a component specific to drying instead of the roller constituting the conveyor. In this configuration, the component is heated, and the recording medium is brought into contact with the heated component and dried due to heat conduction. A porous member such as a felt and a sponge may be used as the dryer. This porous member is disposed so as to contact the recording medium and absorb water therefrom to dry the recording medium. As one example of this configuration, an absorber including a rigid roller and a felt covering an outer surface of the roller may be provided such that the recording medium is brought into contact with an outer circumferential surface of the absorber which is formed of the felt. In this configuration, a suction mechanism may be provided for the roller to suck absorbed water as needed.

The dryer may dry the recording medium using convection and/or radiation without contacting the recording medium. In the case of convection, the temperature of air is not limited, and any of cool air and warm air may be used. Also, the dryer may be configured to dry the recording medium using high-temperature air without generating the convection. In a case of using a recording medium containing water which contains infrared absorbent, the dryer may be configured to dry the recording medium by applying infrared light to the recording medium. The dryer may be configured to dry the recording medium by applying electromagnetic waves to the recording medium to generate heat therein utilizing molecular motion. The dryer may be configured to dry the recording medium by applying ultrasonic waves to the recording medium to repeat depressurization and pressurization. The dryer may be configured to dry the recording medium by sucking water contained in the recording medium by means of a suction mechanism.

Figure 11:
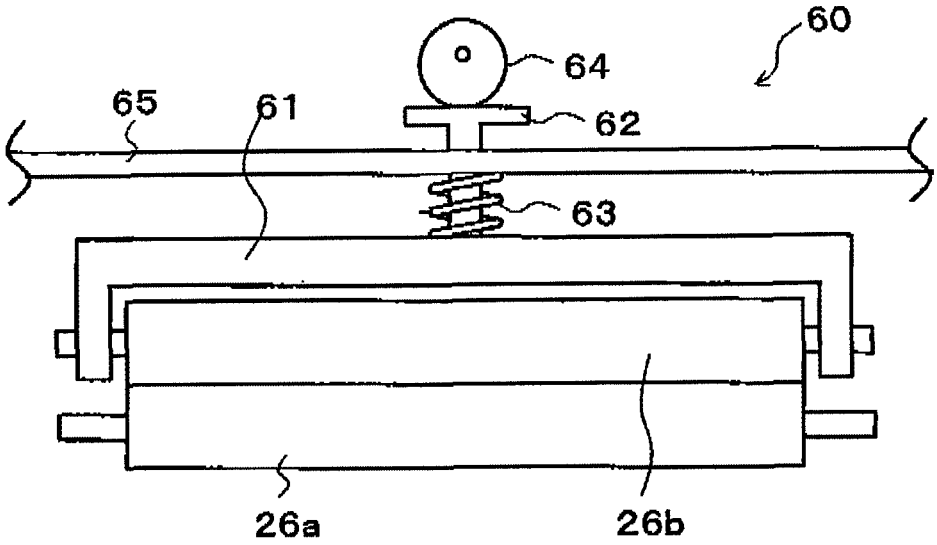
FIG. 11 is a schematic side view of a nip-pressure changing mechanism of a dryer included in an ink-jet printer according to an alternative embodiment of the present invention.

The dryer may further include a nip-pressure changing mechanism 60 for changing a nip pressure of the roller pair 26 partly constituting the dryer. Specifically, as illustrated in FIG. 11, the nip-pressure changing mechanism 60 includes a roller holder 61, an arm 62, a spring 63, and an eccentric cam 64. The roller holder 61 supports a rotation shaft of the roller 26*b* rotatably. The arm 62 has a T-shape when viewed in the horizontal direction and is mounted on an upper face of the roller holder 61. The arm 62 is fitted in a through hole formed in the frame 65 held by the housing 1*a*. The spring 63 urges the roller holder 61 and the frame 65 such that the roller holder 61 and the frame 65 are moved away from each other. The eccentric cam 64 is rotated with its rotation shaft receiving a drive force of a motor. The eccentric cam 64 is rotated in a state in which its outer circumferential surface is held in contact with an upper end portion of the arm 62. The rotation of the eccentric cam 64 changes a nip pressure of the roller 26*a* and the roller 26*b*, the configuration in which the dryer includes the nip-pressure changing mechanism 60, the controller 1*p* may control the nip-pressure changing mechanism 60 such that the nip pressure of the roller pair 26 is different between the second processing and the third processing. More preferably, the controller 1*p* may control the nip-pressure changing mechanism 60 such that the nip pressure of the roller pair 26 is greater in the third processing than in the second processing. In this control, the nip pressure of the roller pair 26 is relatively small in the second processing, preventing the ink from transferring to the roller pair 26 when the image-recorded surface of the sheet P contacts the roller pair 26. In the third processing, on the other hand, the nip pressure of the roller pair 26 is relatively large, improving efficiency of drying the image-recorded surface when the image-recorded surface of the sheet P contacts the roller pair 26. Here, since the image-recorded surface of the sheet P had been heated in the second processing, the image-recorded surface has been dried in some degree at the start of the third processing, making it difficult for the ink to be transferred to the roller pair 26 in the third processing even when the image-recorded surface of the sheet P contacts the roller pair 26. It is noted that in the case of the simplex recording, the controller 1*p* controls the nip-pressure changing mechanism 60 such that the nip pressure of the roller pair 26 is equal to that of the roller pair 26 in the second processing.

The medium conveying path formed by the conveyor is not limited to that in the above-described embodiments and may be changed as needed. A plurality of roller pairs of the conveyor may be rotated at the same speed or different speeds. For example, conveyor motors may be connected respectively to drive rollers of the roller pairs, and rotations of the conveyor motors may be controlled individually. The conveying speed in the first direction and the conveying speed in the second direction may be different from or equal to each other. Any configuration may be employed for a conveyor motor and a drive-power transmitting mechanism.

The controller may control the dryer or both of the dryer and the second conveyor such that an amount of heat applied to the recording medium by the dryer is different between the second processing and the third processing. The controller may control the dryer not to dry the recording medium in the third processing but to dry the recording medium only in the second processing. Specifically, the heater 26*ah* may be turned off between S14 and S15. The controller may control the second conveyor in the second processing such that the conveying speed of the recording medium starts decreasing not after the trailing edge of the recording medium passes through the drying position but after the trailing edge of the image-recorded area on the front surface of the recording medium passes through the drying position. Specifically, the predetermined length of time T may be set, taking margins of the recording medium into consideration. For example, in the case where the distance L1 is equal to or longer than the distance L2, the predetermined length of time T may be set according to the following equation: $T1+T2-\beta \leq T \leq T1+T2+T3'-T4$. The value β is a length of time required for conveyance of a downstream margin of the recording medium in the first direction at the conveying speed V1 and can be obtained by dividing the length of the margin in the first direction by the conveying speed VI. In the case where the distance L1 is shorter than the distance L2, on the other hand, the predetermined length of time T may be set according to the following equation: $T1+T2+\alpha-\beta \leq T \leq T1+T2+T3'-T4$.

The controller may control the second conveyor in the third processing such that the increase in the conveying speed of the recording medium is completed, and the conveying speed becomes constant not before the leading edge of the recording medium conveyed in the second direction D2 passes through the drying position but before the leading edge of the image-recorded area on the front surface of the recording medium passes through the drying position. The controller may control the position of the recording medium and execute the control for conveyance not based on the signals output from the sensors but based on the number of rotations of the conveyor motor.

The predetermined length of time T may be calculated by actual measurements for each size of the recording medium, and the controller may store a table representative of the predetermined length of time T for each size of the recording medium, into the ROM. The controller may obtain the predetermined length of time T in other suitable methods.

While the point in time when the leading edge of the recording medium conveyed in the first direction D1 reaches the sensing position is set as the start of the predetermined length of time T in the above-described embodiments, the point in time when the trailing edge of the recording medium conveyed in the first direction D1 reaches the sensing position may be set as the start of the predetermined length of time T. The sensor may be disposed at any position that is located upstream of the drying position in the first direction. While the controller selectively executes one of the simplex recording control and the duplex recording control based on the recording command in the above-described embodiment, the controller may be configured to execute only the duplex recording control without executing the control for the simplex recording.

The liquid ejection head may be a serial head instead of the line head. The liquid ejected from the liquid ejection head is not limited to the ink and may be any liquid such as pretreatment liquid. The actuator for applying energy for ejecting liquid from the ejection openings is not limited to the piezoelectric actuator using piezoelectric elements and may be other types of actuators such as a thermal actuator using heating elements and an electrostatic actuator using an electrostatic force. The liquid ejection apparatus may include any number of liquid ejection heads as long as at least one liquid ejection head is provided. The recording medium is not limited to the sheet P and may be any recordable medium. The liquid ejection apparatus according to the present invention is not limited to the printer and may be other similar devices such as a facsimile machine and a copying machine.

What is claimed is:

1. A liquid ejection apparatus, comprising:

a liquid ejection head formed with a plurality of ejection openings and configured to eject liquid from the plurality of ejection openings;

a first conveyor configured to convey a recording medium in a first direction to a recording position which opposes the plurality of ejection openings;

a second conveyor disposed downstream of the recording position in the first direction, the second conveyor being configured to convey the recording medium conveyed by the first conveyor, in the first direction and a second direction that is reverse to the first direction;

a third conveyor configured to convey the recording medium conveyed in the second direction by the second conveyor, to an upstream side of the recording position in the first direction to enter the recording medium into a conveyance path of the first conveyor;

a dryer configured to dry the recording medium conveyed by the second conveyor, at a drying position located downstream of the recording position in the first direction; and a controller configured to control the liquid ejection head, the first conveyor, the second conveyor, the third conveyor, and the dryer, the controller being configured to execute:

a first processing in which the controller controls the liquid ejection head and the first conveyor to record an image on a first surface of the recording medium which opposes a second surface thereof;

a second processing in which after the first processing the controller controls the second conveyor to convey the recording medium for which the image is recorded on the first surface thereof; in the first direction until an upstream edge portion of the recording medium in the first direction reaches a position located downstream of the drying position in the first direction;

a third processing in which after the second processing the controller controls the second conveyor to convey the recording medium for which the image is recorded on the first surface thereof; in the second direction; and a fourth processing in which after the third processing the controller controls the third conveyor, the first conveyor, and the liquid ejection head to record an image on the second surface of the recording medium, the controller being configured to control the dryer to dry the recording medium at least in the second processing.

2. The liquid ejection apparatus according to claim 1, wherein the controller controls the dryer to dry the recording medium in both of the second processing and the third processing.

3. The liquid ejection apparatus according to claim 1, wherein the dryer comprises: a first forward/reverse rotatable roller pair at least partly constituting the second conveyor and rotatable forwardly and reversely; and a heater configured to heat at least one of two rollers constituting the first forward/reverse rotatable roller pair.

4. The liquid ejection apparatus according to claim 1, wherein the controller is configured to control the dryer such that a nip pressure of the first forward/reverse rotatable roller pair in the second processing is different from that in the third processing.

5. The liquid ejection apparatus according to claim 1, wherein the second conveyor comprises a second forward/reverse rotatable roller pair rotatable forwardly and reversely and disposed downstream of the drying position in the first direction.

6. The liquid ejection apparatus according to claim 1, wherein the dryer comprises a contact member configured to contact at least the first surface of the recording medium to apply heat to the recording medium.

7. The liquid ejection apparatus according to claim 1, wherein the controller is configured to control the second conveyor in the second processing such that a conveying speed of the recording medium starts decreasing after at least an upstream edge portion of an image-recorded area on the first surface on which the image is recorded in the first direction passes through the drying position.

8. The liquid ejection apparatus according to claim 7, wherein the controller is configured to control the second conveyor in the second processing such that the conveying speed of the recording medium starts decreasing after the upstream edge portion of the recording medium in the first direction passes through the drying position.

9. The liquid ejection apparatus according to claim 7, further comprising a sensor disposed upstream of the drying position in the first direction and configured to output a signal responsive to a position of the recording medium conveyed along a conveyance path, wherein the controller is configured to control the second conveyor to change the conveying speed based on the signal output by the sensor.

10. The liquid ejection apparatus according to claim 1, wherein the controller is configured to control the second conveyor in the third processing such that a conveying speed of the recording medium finishes increasing and becomes constant before at least an upstream edge portion of an image-recorded area on the first surface on which the image is recorded in the first direction passes through the drying position.

11. The liquid ejection apparatus according to claim 10, wherein the controller is configured to control the second conveyor in the third processing such that the conveying speed of the recording medium finishes increasing and becomes constant before the upstream edge portion of the recording medium in the first direction passes through the drying position.

12. The liquid ejection apparatus according to claim 1, wherein the dryer is configured to apply heat to the recording medium, and wherein the controller is configured to control at least one of the second conveyor and the dryer such that an amount of heat applied to the recording medium by the dryer in the second processing is different from that in the third processing.

13. The liquid ejection apparatus according to claim 12, wherein the controller is configured to control the second conveyor such that a conveying speed of the recording medium in the second processing is different from that in the third processing.

14. The liquid ejection apparatus according to claim 13, wherein the controller is configured to control the second conveyor such that the conveying speed of the recording medium is greater in the third processing than in the second processing.

15. The liquid ejection apparatus according to claim 13, wherein the controller is configured to control the second conveyor such that the conveying speed of the recording medium is less in the third processing than in the second processing.

16. A liquid ejection apparatus, comprising:

a liquid ejection head formed with a plurality of ejection openings and configured to eject liquid from the plurality of ejection openings;

a first conveyor configured to convey a recording medium in a first direction to a recording position which opposes the plurality of ejection openings;

a second conveyor disposed downstream of the recording position in the first direction, the second conveyor being configured to convey the recording medium conveyed by the first conveyor, in the first direction and a second direction that is reverse to the first direction;

a third conveyor configured to convey the recording medium conveyed in the second direction by the second conveyor, to an upstream side of the recording position in the first direction to enter the recording medium into a conveyance path of the first conveyor; and a dryer configured to dry the recording medium conveyed by the second conveyor, at a drying position located downstream of the recording position in the first direction, the dryer comprising: a first forward/reverse rotatable roller pair at least partly constituting the second conveyor and rotatable forwardly and reversely; and a heater configured to heat at least one of two rollers constituting the first forward/reverse rotatable roller pair, the second conveyor comprising a second forward/reverse rotatable roller pair rotatable forwardly and reversely, the second forward/reverse rotatable roller pair being disposed downstream of the drying position in the first direction.

* * * * *